US009542880B2

(12) United States Patent
Mariano et al.

(10) Patent No.: US 9,542,880 B2
(45) Date of Patent: Jan. 10, 2017

(54) ELIMINATING FLICKER IN LED-BASED DISPLAY SYSTEMS

(71) Applicant: Maxim Integrated Products, Inc., San Jose, CA (US)

(72) Inventors: Gianluca Mariano, San Martino Siccomario (IT); Suresh Hariharan, Livermore, CA (US)

(73) Assignee: Maxim Integrated Products, Inc., San Jose, CA (US)

( * ) Notice: Subject to any disclaimer, the term of this patent is extended or adjusted under 35 U.S.C. 154(b) by 28 days.

(21) Appl. No.: 14/290,005

(22) Filed: May 29, 2014

(65) Prior Publication Data

US 2015/0194097 A1 Jul. 9, 2015

Related U.S. Application Data

(60) Provisional application No. 61/924,436, filed on Jan. 7, 2014.

(51) Int. Cl.
*G09G 3/34* (2006.01)
*G09G 3/32* (2016.01)

(52) U.S. Cl.
CPC ..... *G09G 3/32* (2013.01); *G09G 2320/0247* (2013.01); *G09G 2320/064* (2013.01)

(58) Field of Classification Search
CPC ..... G09G 3/3406; G09G 3/34; G09G 3/32; G09G 2320/0247; G09G 2320/064; H04H 1/69; H05B 33/0818; H03K 21/38
USPC ..... 315/210, 290–294, 250; 345/202, 690, 345/102; 327/176; 323/282
See application file for complete search history.

(56) References Cited

U.S. PATENT DOCUMENTS

2005/0243894 A1* 11/2005 Chen et al. ..... 375/139
2007/0210725 A1* 9/2007 Marosek ..... 315/291
2009/0267530 A1* 10/2009 Yang ..... H05B 33/0818 315/250
2010/0033110 A1* 2/2010 Chien ..... 315/294
2010/0060181 A1* 3/2010 Choi ..... H05B 33/0809 315/224
2010/0156493 A1* 6/2010 Yedevelly ..... H03K 21/38 327/176
2014/0111110 A1* 4/2014 Qi et al. ..... 315/210

* cited by examiner

*Primary Examiner* — Jonathan Boyd
*Assistant Examiner* — James Nokham

(57) ABSTRACT

A system includes a driver circuit, a modulator circuit, and a reset circuit. The driver circuit drives a plurality of light emitting diodes via a switch. The switch is controlled by a first signal having a first frequency. The driver circuit controls brightness of the light emitting diodes based on a second signal including a plurality of pulses. The modulator circuit modulates the first signal using a direct sequence spread spectrum modulation. The direct sequence spread spectrum modulation uses a sequence generated based on the first signal. The reset circuit resets the modulator circuit at each of the plurality of pulses of the second signal. The modulator circuit repeats the sequence at each of the plurality of pulses of the second signal.

12 Claims, 4 Drawing Sheets

ELIMINATING FLICKER IN LED-BASED DISPLAY SYSTEMS

CROSS-REFERENCE TO RELATED APPLICATIONS

This application claims the benefit of U.S. Provisional Application No. 61/924,436, filed on Jan. 7, 2014. The entire disclosure of the application referenced above is incorporated herein by reference.

FIELD

The present disclosure relates generally to power supplies and more particularly to eliminating visible flicker in LED-based displays powered by switching regulators.

BACKGROUND

The background description provided here is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Light emitting diode (LED) based display systems are becoming increasingly popular due to many advantages LEDs offer over conventional display systems. For example, LEDs are more power efficient and durable than conventional light bulbs. As a result, LED-based display systems are fast becoming a preferred alternative to conventional display systems used in homes, businesses, and vehicles. Additionally, LED-based display systems such as signs and billboards are gaining popularity for similar reasons.

SUMMARY

A system comprises a driver circuit, a modulator circuit, and a reset circuit. The driver circuit drives a plurality of light emitting diodes via a switch. The switch is controlled by a first signal having a first frequency. The driver circuit controls brightness of the light emitting diodes based on a second signal including a plurality of pulses. The modulator circuit modulates the first signal using a direct sequence spread spectrum modulation. The direct sequence spread spectrum modulation uses a sequence generated based on the first signal. The reset circuit resets the modulator circuit at each of the plurality of pulses of the second signal. The modulator circuit repeats the sequence at each of the plurality of pulses of the second signal.

In other features, the plurality of pulses of the second signal has a second frequency. The modulator circuit eliminates visible flicker in the light emitting diodes due to harmonics having frequencies less than the second frequency by repeating the sequence at each of the plurality of pulses of the second signal.

In another feature, the reset circuit synchronizes the first signal and the second signal by resetting the modulator circuit at each of the plurality of pulses of the second signal.

In other features, the modulator circuit comprises a divider circuit, an L bit shift register, and a digital-to-analog converter. The divider circuit divides the first frequency by N and that generates a divided signal, where N is an integer greater than 1. The L bit shift register is clocked by the divided signal and that outputs M of the L bits at every clock cycle of the divided signal, where L an M are integers greater than 1, and where L is greater than M. The digital-to-analog converter converts the M bits into a waveform including $2^M$ discrete steps that change at every clock cycle of the divided signal. The modulator circuit modulates the first signal based on the waveform.

In other features, the sequence includes the M bits that change at every clock cycle of the divided signal. The sequence repeats every $(2^L-1)*N$ clock cycles of the divided signal.

In another feature, the modulator circuit comprises a low-pass filter that filters the waveform generated by the digital-to-analog converter and that has a cutoff frequency equal to the first frequency divided by N.

In another feature, the system further comprises a signal generator that generates the first signal and that controls the first frequency of the first signal based on the filtered waveform.

In still other features, a method comprises driving a plurality of light emitting diodes via a switch and controlling the switch by a first signal having a first frequency. The method further comprises modulating the first signal using a direct sequence spread spectrum modulation. The direct sequence spread spectrum modulation uses a sequence generated based on the first signal. The method further comprises controlling brightness of the light emitting diodes based on a second signal including a plurality of pulses. The method further comprises repeating the sequence at each of the plurality of pulses of the second signal.

In other features, the plurality of pulses of the second signal has a second frequency. The method further comprises eliminating visible flicker in the light emitting diodes due to harmonics having frequencies less than the second frequency by repeating the sequence at each of the plurality of pulses of the second signal.

In other features, the method further comprises dividing the first frequency by N and generating a divided signal, where N is an integer greater than 1. The method further comprises shifting L bits at every clock cycle of the divided signal, where L is an integer greater than 1. The method further comprises outputting M of the L bits at every clock cycle of the divided signal, where M is an integer greater than 1, and where L is greater than M. The method further comprises converting the M bits into a waveform including $2^M$ discrete steps that change at every clock cycle of the divided signal. The method further comprises modulating the first signal based on the waveform.

In another feature, the method further comprises synchronizing the first signal and the second signal by resetting the dividing and the shifting at each of the plurality of pulses of the second signal.

In other features, the sequence includes the M bits that change at every clock cycle of the divided signal. The method further comprises repeating the sequence every $(2^L-1)*N$ clock cycles of the divided signal.

In another feature, the method further comprises filtering the waveform using a low-pass filter having a cutoff frequency equal to the first frequency divided by N.

In another feature, the method further comprises controlling the first frequency of the first signal based on the filtered waveform.

Further areas of applicability of the present disclosure will become apparent from the detailed description, the claims and the drawings. The detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

In the drawings, reference numbers may be reused to identify similar and/or identical elements.

DETAILED DESCRIPTION

In LED-based display systems, a switching regulator (e.g., a Buck regulator) is typically used to regulate current through a string of series-connected LEDs. An average forward current through the LEDs determines brightness of the LEDs. A pulse width modulation (PWM) based control signal switches the LEDs on and off at a high frequency. An effective forward current is a time-based average of a forward current when the LEDs are on and off. When using the PWM method for controlling brightness of the LEDs, the on/off dimming frequency must be faster than the human eye can detect to avoid visible flicker. Dimming frequencies greater than or equal to 200 Hz usually avoid flicker problems.

Direct-sequence spread spectrum modulation (DSSM) is used in switching regulators to reduce radiated and conductive electromagnetic interferences (EMI). When DSSM is used, flicker may be visible at very low duty-cycles (e.g., less than 10%) even if PWM frequencies are greater than or equal to 200 Hz. This is because DSSM can introduce harmonics at frequencies less than the dimming frequency that human eye can detect.

The present disclosure relates to eliminating visible flicker without degrading EMI performance of LED driver circuits. Specifically, the visible flicker can be eliminated by eliminating the harmonics at frequencies less than the dimming frequency in the LED current spectrum, which can be achieved by forcing the same frequency hopping sequence at each PWM pulse of the brightness control signal.

Figure 1:
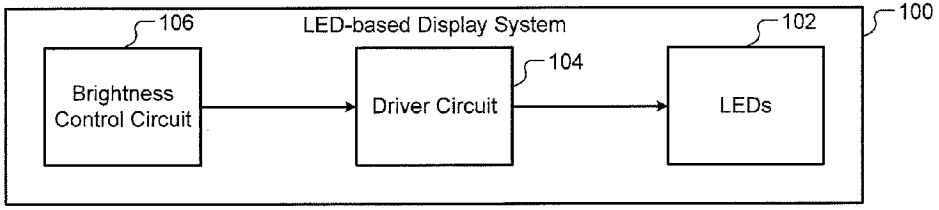
FIG. 1 is a functional block diagram of an LED-based display system.

Referring now to FIG. 1, an LED-based display system 100 includes a plurality of LEDs 102, a driver circuit 104, and a brightness control circuit 106. The LEDs 102 may include a string of LEDs connected in series. The driver circuit 104 drives the LEDs 102. The brightness control circuit 106 provides a brightness control signal to the driver circuit 104. The driver circuit 104 controls the brightness of the LEDs 102 based on the brightness control signal.

Figure 2:
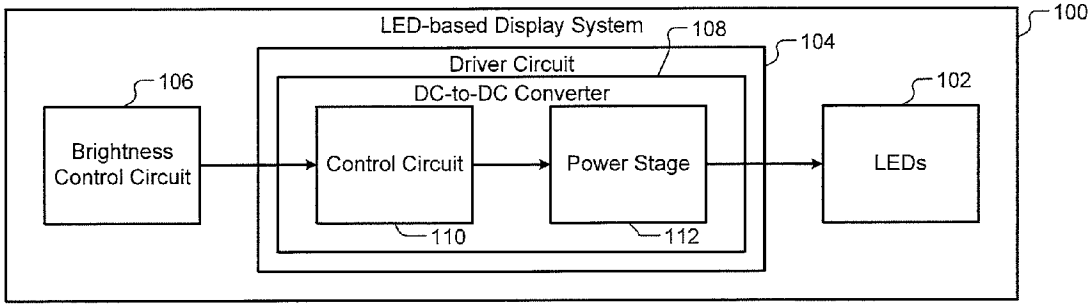
FIG. 2 is a functional block diagram of the LED-based display system of FIG. 1 showing an example a driver circuit used the LED-based display system of FIG. 1.

Referring now to FIG. 2, the driver circuit 104 may include a DC-to-DC converter 108. The DC-to-DC converter 108 typically includes a switching regulator (e.g., a buck regulator). The DC-to-DC converter 108 includes a control circuit 110 and a power stage 112. The power stage 112 may include a switch (or a high side switch and a low side switch depending on implementation) and passive components (e.g., an inductance and a capacitance). The switch (or switches) of the power stage 112 is controlled by the control circuit 110. The control circuit 110 generates a control signal having a switching frequency at which the switch (or switches) of the power stage 112 is turned on and off. For example, the switching frequency may be 400 kHz or 2.1 MHz. The power stage 112 delivers power to the LEDs 102 based on the control signal generated by the control circuit 110.

Figure 3:
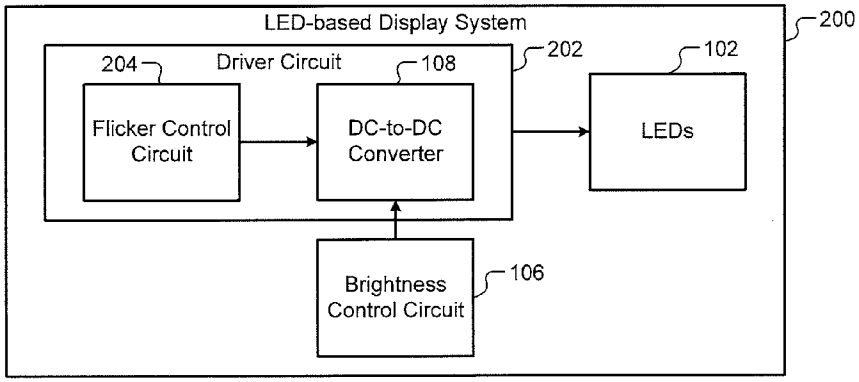
FIG. 3 is a functional block diagram of an LED-based display system including a flicker control circuit.

Referring now to FIG. 3, an LED-based display system 200 includes the LEDs 102, the brightness control circuit 106, and a driver circuit 202. The driver circuit 202 includes the DC-to-DC converter 108 and a flicker control circuit 204. As explained below in detail, the flicker control circuit 204 eliminates the visible flicker by eliminating the harmonics at frequencies less than the dimming frequency in the LED current spectrum. Specifically, the flicker control circuit 204 eliminates the harmonics at frequencies less than the dimming frequency by forcing the same frequency hopping sequence at each PWM pulse of the brightness control signal as explained below.

Figure 4:
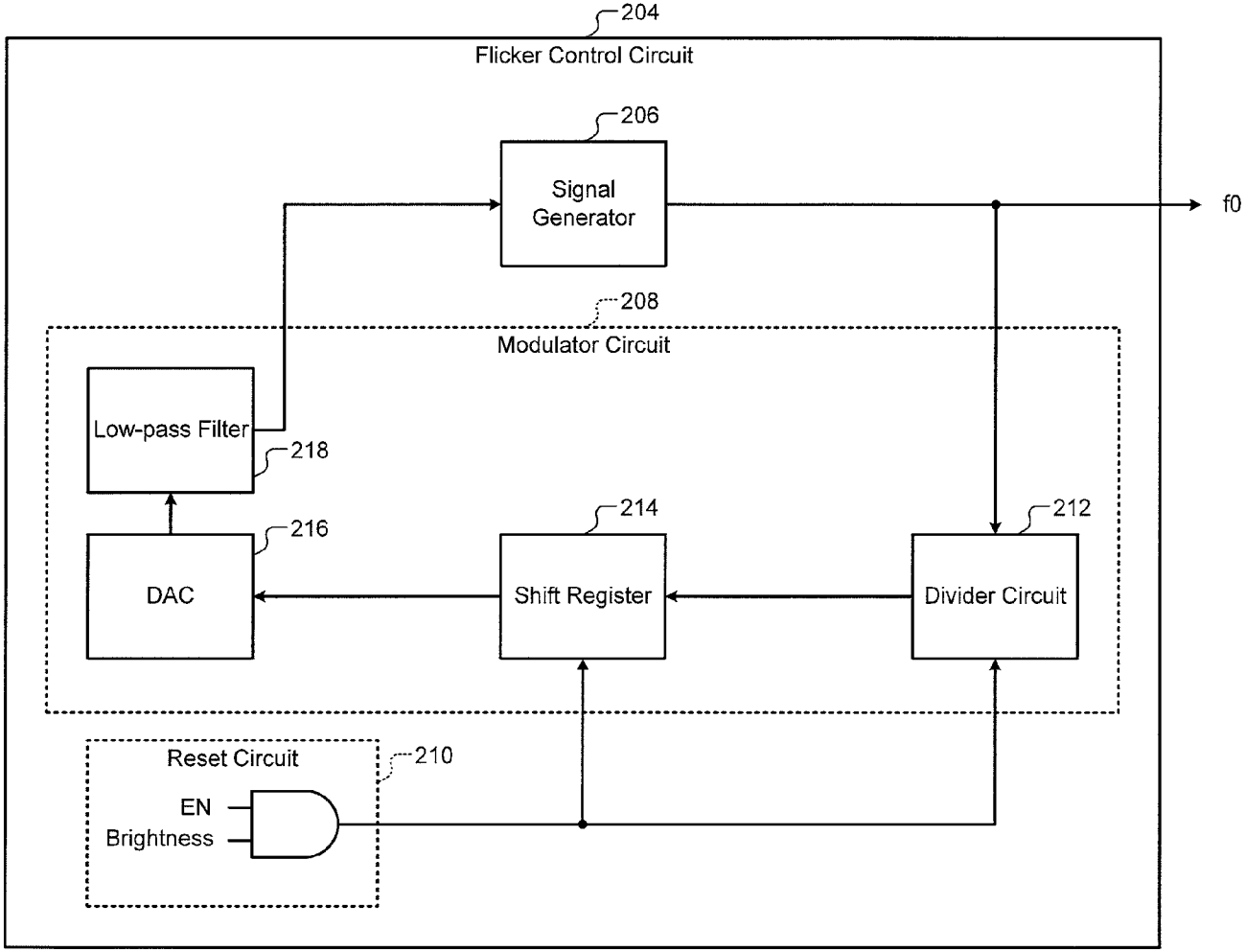
FIG. 4 is a functional block diagram of the flicker control circuit of FIG. 3.

Referring now to FIG. 4, the flicker control circuit 204 includes a signal generator 206, a modulator circuit 208, and a reset circuit 210. The modulator circuit 208 includes a divider circuit 212, a shift register 214, a digital-to-analog converter (DAC) 216, and a low-pass filter 218.

The signal generator 206 includes an oscillator and generates a clock having a predetermined switching frequency. The clock is used to turn on and off the switch (or switches) of the DC-to-DC converter 108 at the switching frequency.

The modulator circuit 208 modulates the switching frequency using DSSM. The reset circuit 210 receives a brightness control signal that includes a plurality of pulse width modulated (PWM) pulses having a predetermined frequency (i.e., dimming frequency; e.g., 100 Hz to 1 kHz). Additionally, the reset circuit 210 may receive an enable signal (EN) that enables or disables the system 200. For example, the enable signal may be based on an input and/or output voltage of the DC-to-DC converter 108. The enable signal may indicate whether the input and/or output voltage of the DC-to-DC converter 108 is greater or less than a predetermined threshold. The enable signal and the brightness control signal may be input to an AND gate, for example, and an output of the AND gate is used to reset the modulator circuit 208. Accordingly, when the enable signal is high, the AND gate generates a reset pulse at each PWM pulse.

The reset circuit 210 resets the modulator circuit 208 at each of the PWM pulses. Accordingly, the modulator circuit 208 repeats a frequency hopping sequence at each of the PWM pulses. Repeating the frequency hopping sequence at each PWM pulse eliminates harmonics having frequencies less than the predetermined frequency of the brightness control signal and eliminates visible flicker in the LEDs 102.

The divider circuit 212 divides the switching frequency by N, where N is a programmable integer greater than 1, and generates a divided signal. For example, N=50 if the switching frequency is 400 kHz, and N=258 and the switching frequency is 2.1 MHz.

The shift register 214 is clocked by the divided signal. For example, the shift register 214 may include a 15-bit pseudorandom noise (PRN) generator. In general, the shift register 214 may be an L-bit shift register, where L is an integer greater than 1 (e.g., L=15). At each clock pulse of the divided signal, the shift register 214 outputs M bits (e.g., 4 bits), where N is an integer greater than 1 and less than L. The shift register 214 generates a pseudorandom sequence that repeats every $(2^L-1)*N$ clock cycles of the divided signal. The pseudorandom sequence is also called a PRN signal.

Figure 5:
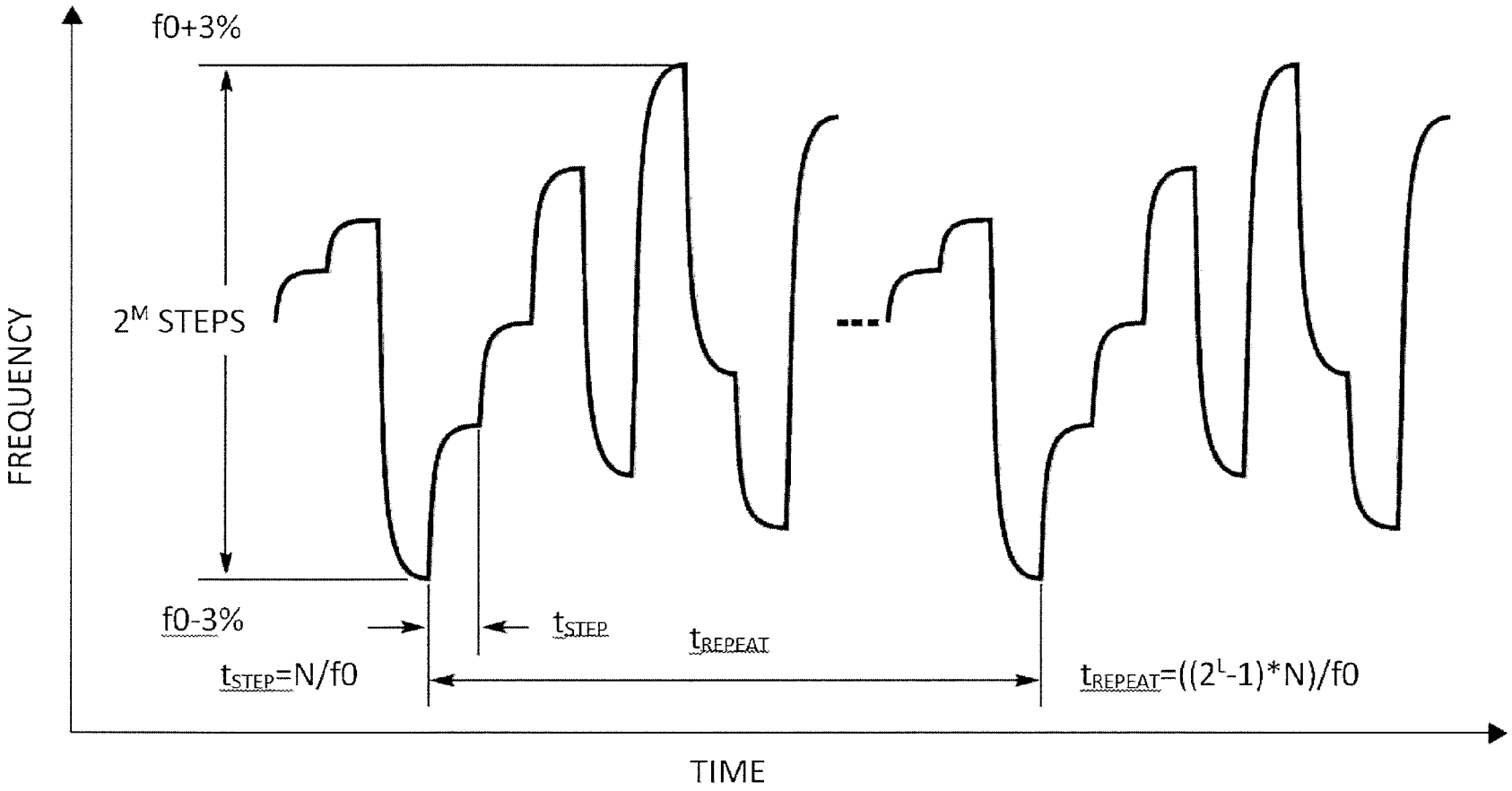
FIG. 5 shows a signal generated by the flicker control circuit of FIG. 4 to eliminate visible flicker in the LED-based display system of FIG. 3.

The DAC 216 converts the M bits into a waveform. The waveform includes $2^M$ discrete steps that change at each clock pulse of the divided signal. The low-pass filter 218 filters the waveform. The filtered waveform is shown in FIG. 5. The low-pass filter 218 has a cutoff frequency (also called corner frequency) $f_c$ equal to $f_0/N$. The cutoff frequency limits the frequency hopping and softens corners of the waveform as shown in FIG. 5. The low-pass filter 218 allows the filtered signal to fully settle at each step as shown in FIG. 5.

The frequency spreading (shown as Δf in FIG. 5) provided by the DAC 216 can be selectable. For example, the value of Δf may include 0, ±3%, ±4%, or ±5%. The value of Δf determines the amount of ripple in the output of the DC-to-DC converter 108.

The switching frequency of the signal generated by the signal generator 206 is controlled by a voltage threshold ($V_{TH_OSC_f}$). $V_{TH_OSC_f}$ is used as a reference by an internal window comparator (not shown) to determinate the switching frequency. When DSSM is enabled, $V_{TH_OSC_f}$ is modulated by the PRN signal generated by the shift register 214. Consequently, the switching frequency will be uniformly distributed between f0−5%<f<f0+5%, for example, if Δf=+/−5% is selected.

The brightness of the LEDs 102 is controlled by the PWM pulses in the brightness control signal. Due to DSSM, the shape of each current pulse supplied to the LEDs 102 can be slightly different if the frequency hopping sequence is different. The shape of each current pulse can be different depending on the different frequency hopping sequence if the PNR generator in the shift register 214 is independent of the brightness control signal. The LED current includes harmonics having frequencies less than the frequency of the PWM pulses in the brightness control signal, which the human eye is able to detect as visible flicker.

The reset circuit 210 resets the shift register 214 and the divider circuit 212 at each PWM pulse in the brightness control signal. Therefore, the frequency hopping sequence generated by the shift register 214 restarts and repeats at every PWM pulse. As a result, the frequency hopping sequence in each current pulse output to the LEDs 102 is forced to be the same. Consequently, the harmonics having frequencies less than the frequency of the PWM pulses in the brightness control signal are eliminated from the LED current. Accordingly, the human eye does not detect any visible flicker in the LEDs 102.

Figure 6:
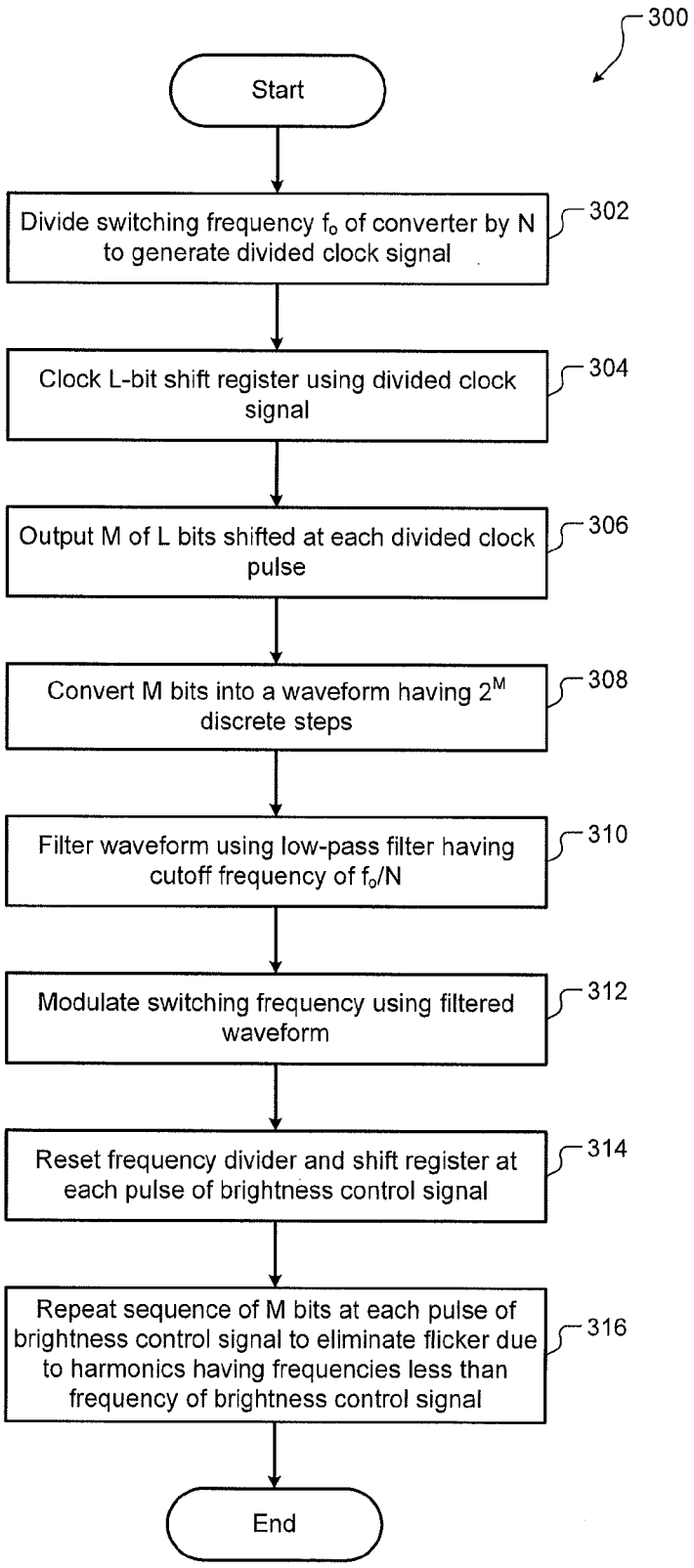
FIG. 6 is a flowchart of a method for eliminating visible flicker in an LED-based display system.

Referring now to FIG. 6, a method 300 for eliminating visible flicker in LED-based displays is shown. At 302 the switching frequency $f_0$ of the converter driving the LEDs is divided by N that generates a divided clock signal, where N is an integer greater than 1. At 304, an L-bit shift register is clocked using the divided clock signal, where L is an integer greater than 1. At 306, M of the L bits shifted at each clock pulse of the divided clock signal are output, where M is an integer greater than 1 and less than L.

At 308, the M bits are converted into a waveform having $2^M$ discrete steps. At 310, the waveform is filtered using a low-pass filter having a cutoff frequency $f_c=f_o/N$. At 312, the switching frequency is modulated using the filtered waveform. At 314, the frequency divider and the shift register are reset at each PWM pulse of a brightness control signal. At 316, the sequence of M bits is repeated at each PWM pulse of the brightness control signal to eliminate flicker due to harmonics having frequencies less than the frequency of the PWM pulses in the brightness control signal.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. As used herein, the phrase at least one of A, B, and C should be construed to mean a logical (A or B or C), using a non-exclusive logical OR. It should be understood that one or more steps within a method may be executed in different order (or concurrently) without altering the principles of the present disclosure.

What is claimed is:

1. A system comprising:

a driver circuit that drives a plurality of light emitting diodes via a switch, wherein the switch is controlled by a first signal having a first frequency, wherein the driver circuit controls brightness of the light emitting diodes based on a second signal including a plurality of pulses, wherein the plurality of pulses of the second signal has a second frequency, wherein the first signal is different than the second signal, and wherein the first frequency is different than the second frequency;

a modulator circuit that modulates the first signal using a direct sequence spread spectrum modulation, wherein the direct sequence spread spectrum modulation uses a sequence generated based on the first signal; and a reset circuit that resets the modulator circuit at each of the plurality of pulses of the second signal, wherein the modulator circuit repeats the sequence generated based on the first signal at each of the plurality of pulses of the second signal and eliminates flicker in the light emitting diodes by eliminating harmonics having frequencies less than the second frequency by repeating the sequence generated based on the first signal at each of the plurality of pulses of the second signal.

2. The system of claim 1 wherein the reset circuit synchronizes the first signal and the second signal by resetting the modulator circuit at each of the plurality of pulses of the second signal.

3. The system of claim 1 wherein the modulator circuit comprises:

a divider circuit that divides the first frequency by N and that generates a divided signal, wherein N is an integer greater than 1;

an L bit shift register that is clocked by the divided signal and that outputs M of the L bits at every clock cycle of the divided signal, wherein L an M are integers greater than 1, and wherein L is greater than M; and a digital-to-analog converter that converts the M bits into a waveform including $2^M$ discrete steps that change at every clock cycle of the divided signal, wherein the modulator circuit modulates the first signal based on the waveform.

4. The system of claim 3 wherein the sequence includes the M bits that change at every clock cycle of the divided signal and wherein the sequence repeats every $(2^L-1)*N$ clock cycles of the divided signal.

5. The system of claim 3 wherein the modulator circuit comprises a low-pass filter that filters the waveform generated by the digital-to-analog converter and that has a cutoff frequency equal to the first frequency divided by N.

6. The system of claim 5 further comprising a signal generator that generates the first signal and that controls the first frequency of the first signal based on the filtered waveform.

7. A method comprising:

driving a plurality of light emitting diodes via a switch;

controlling the switch by a first signal having a first frequency;

modulating the first signal using a direct sequence spread spectrum modulation, wherein the direct sequence spread spectrum modulation uses a sequence generated based on the first signal;

controlling brightness of the light emitting diodes based on a second signal including a plurality of pulses, wherein the plurality of pulses of the second signal has a second frequency, wherein the first signal is different than the second signal, and wherein the first frequency is different than the second frequency;

repeating the sequence generated based on the first signal at each of the plurality of pulses of the second signal; and eliminating flicker in the light emitting diodes by eliminating harmonics having frequencies less than the second frequency by repeating the sequence generated based on the first signal at each of the plurality of pulses of the second signal.

8. The method of claim 7 further comprising:

dividing the first frequency by N and generating a divided signal, wherein N is an integer greater than 1;

shifting L bits at every clock cycle of the divided signal, wherein L is an integer greater than 1;

outputting M of the L bits at every clock cycle of the divided signal, wherein M is an integer greater than 1, and wherein L is greater than M;

converting the M bits into a waveform including $2^M$ discrete steps that change at every clock cycle of the divided signal; and modulating the first signal based on the waveform.

9. The method of claim 8 further comprising synchronizing the first signal and the second signal by resetting the dividing and the shifting at each of the plurality of pulses of the second signal.

10. The method of claim 8 wherein the sequence includes the M bits that change at every clock cycle of the divided signal, the method further comprising repeating the sequence every $(2^L-1)*N$ clock cycles of the divided signal.

11. The method of claim 8 further comprising filtering the waveform using a low-pass filter having a cutoff frequency equal to the first frequency divided by N.

12. The method of claim 11 further comprising controlling the first frequency of the first signal based on the filtered waveform.

* * * * *